US009038646B2

(12) United States Patent
Joost et al.

(10) Patent No.: US 9,038,646 B2
(45) Date of Patent: May 26, 2015

(54) CLEANING MACHINE

(75) Inventors: Holger Joost, Flensburg (DE); Jan Momsen, Bredstedt (DE); Bernd Hansen, Rantrum (DE)

(73) Assignee: KRONES AG, Neutraubling (DE)

( * ) Notice: Subject to any disclaimer, the term of this patent is extended or adjusted under 35 U.S.C. 154(b) by 762 days.

(21) Appl. No.: 12/851,570

(22) Filed: Aug. 6, 2010

(65) Prior Publication Data

US 2011/0036380 A1 Feb. 17, 2011

(30) Foreign Application Priority Data

Aug. 12, 2009 (DE) ..... 10 2009 037 188

(51) Int. Cl.
*B08B 9/44* (2006.01)

(52) U.S. Cl.
CPC ..... *B08B 9/44* (2013.01)

(58) Field of Classification Search
CPC ..... D06F 9/44
USPC ..... 134/64 R, 124, 129, 131
See application file for complete search history.

(56) References Cited

U.S. PATENT DOCUMENTS

| | | | | |
|---|---|---|---|---|
| 3,076,730 | A * | 2/1963 | Nolte | 134/25.2 |
| 3,106,925 | A * | 10/1963 | Burton | 134/47 |
| 3,468,320 | A * | 9/1969 | Cumming | 134/46 |
| 3,942,420 | A * | 3/1976 | Marino | 454/51 |
| 3,949,770 | A * | 4/1976 | Noren | 134/60 |
| 3,985,226 | A * | 10/1976 | Noren | 198/738 |
| 5,755,246 | A * | 5/1998 | Carl et al. | 134/73 |
| 5,758,674 | A * | 6/1998 | Taeger | 134/131 |
| 6,311,526 | B1 * | 11/2001 | Frushtick | 68/5 C |
| 6,616,770 | B2 * | 9/2003 | Musha et al. | 134/10 |
| 2009/0178296 | A1 * | 7/2009 | Duenzinger et al. | 34/413 |

FOREIGN PATENT DOCUMENTS

| | | | |
|---|---|---|---|
| DE | 8203951 | U1 | 9/1982 |
| DE | 3413797 | A1 | 11/1985 |
| DE | 3534410 | A1 | 6/1986 |
| DE | 10112312 | A1 | 9/2002 |
| JP | 59142186 | A | 8/1984 |
| WO | WO-2009038445 | A2 | 3/2009 |

OTHER PUBLICATIONS

European Search Report for EP 10 16 5545 dated Oct. 29, 2010.
Office Action, The State of Intellectual Property Office of P.R. China, dated Jun. 19, 2012.

* cited by examiner

*Primary Examiner* — Michael Barr
*Assistant Examiner* — Jason Riggleman
(74) *Attorney, Agent, or Firm* — Marshall, Gerstein & Borun LLP

(57) ABSTRACT

A cleaning machine for containers, containing a housing in which various treatment stations, including a feed station and a discharge station, are accommodated, whereby the housing has two side walls located opposite each other. In order to simplify the installation of the cleaning machine, a modular construction is used, whereby at least the discharge station is formed as a module.

6 Claims, 2 Drawing Sheets

CLEANING MACHINE

CROSS-REFERENCE TO RELATED APPLICATION

The present application claims the benefit of priority of German Application No. 102009037188.5, filed Aug. 12, 2009. The entire text of the priority application is incorporated herein by reference in its entirety.

FIELD OF THE DISCLOSURE

The disclosure relates to a cleaning machine of the type used for cleaning containers.

BACKGROUND

A cleaning machine of this kind is known from DE 10 2005 018 382. The known cleaning machine, like all machines of that type, has a housing that contains at least two opposing side walls, but that is usually closed all around. A very wide range of cleaning stations is accommodated in the interior of the housing, whereby usually a cleaning bath that works with a heated cleaning alkaline solution is provided. The containers are rinsed or sprayed off in a further station, whereby a cold liquid, particularly clean water, is used for this step. Furthermore accommodated in the housing is a conveyer that conveys the containers through the different cleaning zones. The containers enter the housing via a feed opening and leave the housing via a discharge opening. Furthermore provided in the housing are separating walls in the form of interior plates that, firstly, support the housing and, secondly, serve as supports or installation aids for the inserted devices in the housing. Cleaning machines of this type are relatively large, because sufficient time, and consequently a relatively long conveyor section, is required for complete automatic cleaning of even extremely dirty containers. In order to save set-up space, the known cleaning machine is formed as a so-called one-end machine, i.e., feed and discharge openings are both on the same wall, particularly the same front wall (at right angles to the conveyor section). Installation of this relatively large housing is difficult, however. Housings are usually installed with the help of a frame that is pre-manufactured and mounted, and to which the walls and inserted devices are then mounted.

In DE 10 2007 019 378 A1 and DE 10 2007 041 251 A1, it was furthermore already proposed that a type of auxiliary construction in the form of a holding device be provided, whereby this auxiliary construction initially fixes in place in a perpendicular position the side walls that oppose one another in a parallel manner, until this fixing in place is taken over by interior plates and inserted devices that are welded on and in. The provision of the holding device is, however, also relatively complicated and expensive.

SUMMARY OF THE DISCLOSURE

The basis of the disclosure is formed by the object of providing a cleaning machine whose installation is simplified.

The number of parts to be installed in the support state of the housing is reduced by means of the development according to the disclosure, as a result of which the weight is also reduced, so that there is no longer a risk of angular deviations or the like. If the discharge module holds the parts of the side wall assigned to the discharge module, the size of the side wall is also reduced. In this way, installation with reclining side wall is possible, so that only the interior inserted devices, not the side wall, must be supported. The second side wall can then be placed on the pre-installed, reclining parts.

The discharge module also preferably contains an ejector conveyor.

It is furthermore expedient also to form the feed station as a module, as a result of which the installation is further simplified.

A further possibility for simplifying the installation lies in separating the side wall parts horizontally, as a result of which the housing can be manufactured in two parts or modules lying one above the other horizontally.

At the same time, it is expedient to provide the butt joint between two cleaning zones, particularly between a cleaning zone working with a higher temperature and one working with a lower temperature. If the side wall parts are then thermally insulated from one another by the butt joint, it is possible to work in an energy-saving manner.

The insulation could be achieved by means of an air gap, but is preferably achieved by means of insulating material, whereby particularly an intermediate plastic layer, preferably roughly 40 mm thick, is used.

BRIEF DESCRIPTION OF THE DRAWINGS

One embodiment of the disclosure is explained in more detail in the following, using the drawings. Shown are:

FIG. 1 a perspective, schematic representation of a cleaning machine according to the disclosure, and FIG. 2 a cut through the cleaning machine shown in FIG. 1 with separation of the modules drawn in.

DETAILED DESCRIPTION OF THE PREFERRED EMBODIMENT

Figure 1:
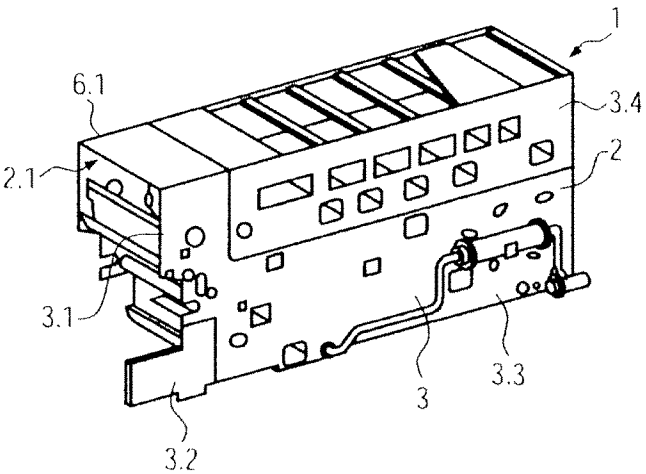

FIG. 1 shows a schematic, perspective representation of a cleaning machine 1, as is used for automatic cleaning of containers, particularly bottles and other returnable vessels.

Figure 2:
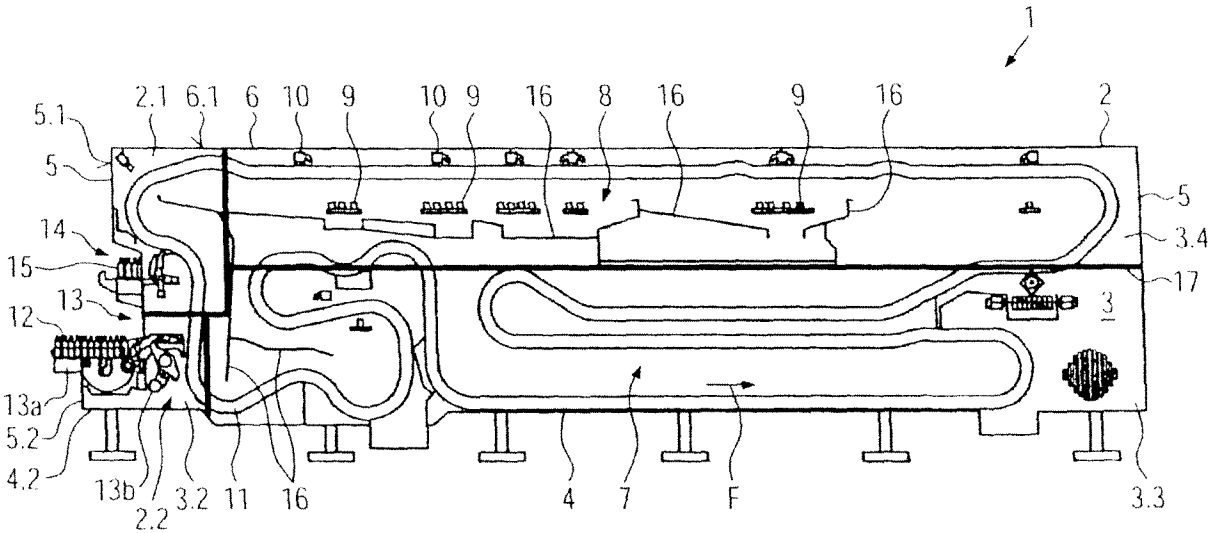

As also apparent in connection with FIG. 2, the cleaning machine 1 contains a housing 2 with two opposing side walls 3, a bottom 4, two opposing front walls 5 and a cover 6 optionally provided on an area-by-area basis.

Various cleaning zones are provided in the interior of the housing 2, whereby to be mentioned as cleaning zones are only an alkaline solution bath 7 and a rinsing zone 8 with spray nozzles 9 or surge devices 10. The individual cleaning zones 7 and 8 are connected to each other by means of an endless conveyor 11, which has suitable holding devices for containers 12, shown in the figure are bottles, whereby these holding devices are not shown in the figure. The containers 12 are introduced into the housing 2 at a feed station 13 and passed to the conveyor 11, and leave the housing 2 at a discharge station 14, where they are picked up by the conveyor 11 and conveyed out of the housing 2 via an ejector conveyor 15. The cleaning machine is formed as a one-end machine in the embodiment shown, i.e., feed and discharge station 13, 14 are located on the same front wall. The conveyor 11 then returns to the feed station 13 in the conveying direction F in order to be reloaded. Supports and/or separating plates 16 that are provided in the interior of the housing serve the installation of the inserted devices and/or separation of the cleaning stations.

As particularly apparent from FIG. 1, the housing 2 has a modular structure and contains a module 2.1 that contains the discharge station 14 and preferably also the ejector conveyor 15. The discharge module 2.1 contains opposing parallel parts of the side wall 3.1 as well as the assigned parts 6.1 of the cover and 5.1 of the front wall.

In addition to the discharge module 2.1, the feed station can also be formed as a module 2.2, whereby this module has been left out of FIG. 1 for the sake of clarity. The module 2.2 contains the feed station 13 with the feed conveyor or feed table 13*a* and the handover device 13*b* for handing over and attaching the containers 12 to the conveyor 11. The feed module 2.2 is also provided with the assigned areas 3.2 of the side walls 3, 4.2 of the bottom 4 and 5.2 of the assigned front wall 5.

Both modules 2.1 and 2.2 can be pre-manufactured outside of the complete housing 2 and then attached to the complete housing 2, preferably in a removable manner.

In addition to the modular formation of the discharge station 14 or the feed station 13, the rest of the housing 2 can also be constructed of side wall modules. In the depicted embodiment, the largest or longest boundaries, the side walls 3, which extend parallel in the conveying direction F, are separated into a first side wall part 3.3 and a second side wall part 3.4. In the case of cleaning machines 1 without a modular construction, the feed or discharge station 13, 14 extends across the entire length of the machine, while in the depicted embodiment they extend up to the corresponding modules 2.2 and 2.3. The two side wall parts 3.3 and 3.4 are separated from each other by an essentially horizontal separating joint 17. The separating joint 17 preferably runs between the cleaning stations 7 and 8 that lie one on top of the other and that work at different temperatures and are preferably located at a position where there is no fear of sealing problems with regard to fluid leakage. In addition to promoting easier installation, the butt joint 17 also promotes a thermal decoupling of the two cleaning zones 7, 8 even in the area of the side walls. This can optionally be brought about by means of a simple air gap, but preferably takes place by means of an insulating material, such as, for example, a plastic strip or the like as an intermediate layer. The intermediate layer is preferably roughly 40 mm thick.

During the installation of the cleaning machine 1 according to the disclosure, first the housing 2 is installed, whereby each of the two pairs of the side wall parts 3.3 and 3.4 can be laid flat on the floor and the separating walls and supports 16 can be welded and applied to the flat lying side wall parts 3.3 or 3.4. Then the opposing side wall part 3.3 or 3.4 of the pair is placed and likewise mounted. Then the side wall modules installed in this way are laid one on top of the other, whereby the insulating material is optionally laid in between. Then the inserted devices can be placed into the housing 2. Finally, the likewise separately pre-manufactured other modules, for example, the discharge module 2.1 and the feed module 2.2 are installed, whereby insulating material is likewise optionally laid in between.

In modification to the described and drawn embodiment, the disclosure can also be used with two-end cleaning machines in which the feed and discharge of the containers take place on opposite ends of the machine. The side walls can also be put together from more than two horizontally separated side wall parts. Other areas of the cleaning machine can also be formed as complete modules, i.e., including the inserted devices.

The invention claimed is:

1. Cleaning machine for containers, comprising a housing, in which different stations, including a feed station and a discharge station, are accommodated, which stations are connected to one another via a circulating conveyor, the housing having two side walls lying opposite each other, and wherein at least the discharge station is formed as a module, wherein the side walls of the housing are of a modular construction and comprise at least two side wall parts, which are separated from one another by a butt joint which runs substantially horizontally, wherein the butt joint is provided between two cleaning zones being arranged on top of each other, a cleaning zone that operates at a higher temperature and a cleaning zone that operates at a lower temperature, and wherein the side wall parts are thermally insulated from one another via the butt joint, and wherein the circulating conveyor extends through both cleaning zones.

2. Cleaning machine according to claim 1, wherein the discharge module contains an ejector conveyor.

3. Cleaning machine according to claim 1, wherein the feed station is formed as a module.

4. Cleaning machine according to claim 1, and wherein an insulating material is arranged between the side wall parts.

5. Cleaning machine according to claim 4, wherein the insulating material is a plastic intermediate layer.

6. Cleaning machine according to claim 5, wherein the plastic intermediate has a thickness of 40 mm.

* * * * *